US011589630B2

(12) United States Patent
Kleiven

(10) Patent No.: US 11,589,630 B2
(45) Date of Patent: Feb. 28, 2023

(54) PROTECTIVE DEVICE

(71) Applicant: Svein Kleiven, Stockholm (SE)

(72) Inventor: Svein Kleiven, Stockholm (SE)

( * ) Notice: Subject to any disclaimer, the term of this patent is extended or adjusted under 35 U.S.C. 154(b) by 248 days.

(21) Appl. No.: 16/954,557

(22) PCT Filed: Dec. 12, 2018

(86) PCT No.: PCT/SE2018/051301
§ 371 (c)(1),
(2) Date: Jun. 17, 2020

(87) PCT Pub. No.: WO2019/125282
PCT Pub. Date: Jun. 27, 2019

(65) Prior Publication Data

US 2020/0329802 A1 Oct. 22, 2020

(30) Foreign Application Priority Data

Dec. 18, 2017 (SE) ..... 1751565-1

(51) Int. Cl.
*A42B 3/06* (2006.01)
*A42B 3/12* (2006.01)

(52) U.S. Cl.
CPC ..... *A42B 3/064* (2013.01); *A42B 3/12* (2013.01)

(58) Field of Classification Search
CPC ..... A42B 3/064; A42B 3/063; A42B 3/06; A42B 3/065; A42B 3/12; A42B 3/121;
(Continued)

(56) References Cited

U.S. PATENT DOCUMENTS 3,818,508 A * 6/1974 Lammers ..... A42B 3/121 2/412
3,877,076 A * 4/1975 Summers ..... A42B 3/124 2/414

(Continued)

FOREIGN PATENT DOCUMENTS

CN 101299938 A 11/2008
CN 102892320 A 1/2013

(Continued)

OTHER PUBLICATIONS

International Search Report and Written Opinion for corresponding International Patent Application No. PCT/SE2018/051301 dated Mar. 14, 2019.

(Continued)

*Primary Examiner* — Katherine M Moran
*Assistant Examiner* — Grady Alexander Nunnery
(74) *Attorney, Agent, or Firm* — Renner, Otto, Boisselle & Sklar, LLP

(57) ABSTRACT

The present disclosure relates to a protective device (100) for protecting a head from impact, the device 100 comprising a shell (110) substantially formed in a dome-shape and having a first outer edge (1101); an inner layer (120) substantially formed in the dome-shape disposed within the shell (110), having an second outer edge (1201) and arranged at a gap distance in a direction of in the surface normal of the shell (110), at least one connecting member (130) interconnecting the shell (110) and inner layer (120) by interconnecting the first outer edge (1101) and the second outer edge (1201), an intermediary structure (140) comprising a plurality of deformable elements (1401) arranged in a single layer, wherein each of the deformable elements (1401), in an undeformed state, is arranged in simultaneous contact with the shell (110), the inner layer (120) and at least (Continued)

one other deformable element of the deformable elements (1401).

10 Claims, 11 Drawing Sheets

(58) Field of Classification Search
CPC ..... A42B 3/124; A42B 3/127; A42B 3/32; A63B 71/10; F41H 1/04; F41H 1/06; F41H 1/08
USPC ..... 2/411
See application file for complete search history.

(56) References Cited

U.S. PATENT DOCUMENTS

| | | | | | |
|---|---|---|---|---|---|
| 4,472,472 | A | | 9/1984 | Schultz | |
| 4,586,200 | A | * | 5/1986 | Poon | A42B 3/122 2/424 |
| 5,699,561 | A | * | 12/1997 | Broersma | B29C 44/18 264/154 |
| 6,658,671 | B1 | * | 12/2003 | Von Holst | A42B 3/064 2/412 |
| 8,533,869 | B1 | * | 9/2013 | Capuano | A42B 3/124 2/411 |
| 2016/0316847 | A1 | * | 11/2016 | Weber | A42B 3/125 |
| 2017/0303622 | A1 | | 10/2017 | Stone et al. | |
| 2017/0318891 | A1 | * | 11/2017 | Walterspiel | A42B 3/064 |

FOREIGN PATENT DOCUMENTS

| | | | | | |
|---|---|---|---|---|---|
| CN | 103 284 392 | A | | 9/2013 | |
| CN | 202476548 | U | | 10/2013 | |
| EP | 1 942 759 | A2 | | 4/2008 | |
| JP | 2013-057137 | A | | 3/2013 | |
| WO | 99/49745 | A1 | | 10/1999 | |
| WO | WO-9949745 | A1 | * | 10/1999 | A42B 3/065 |
| WO | 2007/052015 | A2 | | 5/2007 | |

OTHER PUBLICATIONS

Chinese Search Report issued in corresponding Chinese Application No. 2018800885020 dated Apr. 27, 2022 and English translation.

* cited by examiner

PROTECTIVE DEVICE

TECHNICAL FIELD

The present disclosure relates to protective devices for protecting a head of a person from impact, in particular protective helmets providing improved impact protection against angular acceleration and angular velocity, e.g. for oblique impacts, when the head to be protected is subjected to rotational forces.

BACKGROUND

When the head of a person is subjected to impact, e.g. when falling over or when exercising a sport, brain injuries may easily be induced. Traumatic brain injuries are even more easily induced by large magnitudes of rotational kinematics caused primarily by oblique impacts to the surface of the head or to a surface of a protective device, such as a helmet, worn on or over the head. The brain and other organs are sensitive to an impact that results in acceleration of the organ. There are two distinct types of accelerations of the head that can occur at an impact, namely linear and angular acceleration. Instances of pure angular acceleration, e.g. rotation about the center of rotation of the skull are rare. The most common type of motion of the head is a combined linear and angular motion. Angular or rotational motion is induced by an oblique impact creating both tangential and normal force components on the helmet and is considered to cause a relatively greater damage to the brain than linear acceleration.

It can be appreciated that a material that protects e.g. the head and brain from different types of impacts can be used in several different contexts, including helmets, vehicle interiors, vehicle exteriors and boxing gloves.

A problem with conventional helmets is that they transfer a large amount of any tangential forces, resulting from an impact to the head or device, into a rotational motion of the head. This is due to the fact that conventional helmets typically have a continuous liner material, usually made of cellular polymer foams, adhered to a hard outer shell.

Damage to the brain due to linear and angular acceleration is discussed e.g. in Ommaya, A. K. and Gennarelli, T. A., "Cerebral Concussion and Traumatic Unconsciousness: Correlations of Experimental and Clinical Observations on Blunt Head Injuries", Brain, 97, 633-654 (1974) and Kleiven, S. "Why most traumatic brain injuries are not caused by linear acceleration but skull fractures are", Frontiers in bioengineering and biotechnology, 1. (2013). Examples of rotational injuries are on the one hand subdural haematomas (SDH), which are bleeding as a consequence of blood vessels rupturing, and on the other hand diffuse axonal injuries (DAI), which can be summarized as nerve fibers being injured. Depending on the characteristics of the rotational force, such as the duration, amplitude and rate of increase, either SDH or DAI occur, or a combination of these is suffered.

Different types of padding are efficient in reducing linear acceleration but the prior art contains few examples of padding or shock attenuation systems intended to mitigate angular acceleration/motion. This lack of systems intended to reduce the angular acceleration and angular velocity is significant. In addition, the materials or systems that best manage or modulate linear forces may in many instances not best manage or modulate angular forces.

Many different arrangements are used in modern motor vehicles, such as automobiles, in order to protect the drivers, passengers and pedestrians in the event of a collision and other types of accidents. However, the prior art in the field contains relatively few examples of materials or structures intended to manage changes in angular acceleration and angular velocity.

There are many examples of helmets or protective headgear intended to attenuate shock directed at the head. Helmets or protective headgear are used in many human sports and activities such as cycling, motorcycling, American football, racing, martial arts, equestrian sports, lacrosse, baseball, hockey, inline skating, skateboarding, skiing, snowboarding, kayaking and rock climbing. Protective headgear is also used in work activities such as construction activities, military activities and fire-fighting activities.

One strategy of reducing angular acceleration of the head when subjected to an impact force is to use two or more layers/sections that can slide relative to each other after an impact. This approach is described in U.S. Pat. No. 6,658,671. The patent describes a helmet that has an outer shell separated from the inner shell by at least one sliding layer, enabling it to be moved relative to the inner shell. Coupling fittings at opposite ends of the two shells are used to absorb energy generated as a result of this relative movement, enabling the shock of a downward impact against the helmet to be effectively absorbed. This design reduces the angular forces/acceleration on the brain by approximately 30-40%.

A somewhat similar concept is described in Chinese Patent No. CN103284392A. In this patent, a helmet is described which contains spherical elements (2). However, the spheres are placed at a distance from each other connected with elements (6) or (7) and each sphere is placed in a shallow furrow (5) which has the disadvantage to prevent rolling and separation of the elements to protect against angular forces or rotational acceleration.

In CN202476548U, a helmet is described which contains spherical elements 3 is described. This invention only describes small spheres without contact between themselves and both the inner and outer shell layers. This has the disadvantage to provide poor protective effect in case of angular acceleration and angular velocity at an oblique impact.

JP2013057137A describes a protective headgear which contains spherical elements 21. However, the spheres are placed at a distance from each other connected with embodiments 22a or 26 which has the disadvantage to prevent rolling and separation of the elements to protect against angular forces or rotational acceleration and angular velocity.

WO9949745A1 describes a protective headgear which contains spherical elements 4. However, most of the spheres are without contact between both the inner and outer shell layers which has the disadvantage to prevent rolling and separation of the elements to protect against angular forces or rotational acceleration and angular velocity.

US2017318891A1, describes a helmet which contains compressible balls 200. However, the compressible balls are placed without initial contact between themselves which has the disadvantage to prevent rolling and separation of the elements to protect against angular forces or rotational acceleration and angular velocity. Also, the spheres are constrained by the walls of ventilation openings 104, or connected with breakable attachment members 312, flexible strings 320, or housed within a tubular net or mesh material 340. This will constrain the motion and has the disadvantage to prevent rolling and separation of the elements to protect against angular forces or rotational acceleration. One configuration described contains compressible balls 500 and one or more attachment members 600 between them as a part of a structural padding system 400. This will constrain the motion and has the disadvantage to prevent rolling and separation of the elements to protect against angular forces or rotational acceleration.

US2017303622A1 describes a protective headgear impact absorbing material comprising arrays of various hexagonal or other deformable polygonal-shaped structures positioned between an exterior surface and an interior surface. One configuration contains impact absorbing structures 615 having a spherical wireframe shape, in accordance with another embodiment. The wire frame shape will exclude having a smooth, spherical outer surface. This has the disadvantage to prevent rolling of the impact absorbing structures to protect against angular forces or rotational acceleration and angular velocity.

Thus there is a need to provide a solution which mitigates or solves the described drawbacks and problems, in particular providing improved impact protection against linear and angular acceleration, e.g. at for oblique impacts, when the head is subjected to rotational forces.

SUMMARY

An objective of embodiments of the invention is to provide a solution which mitigates or solves the drawbacks and problems described above. The above and further objectives are achieved by the subject matter described herein. Further advantageous embodiments or implementation forms of the invention are also defined herein.

According to a first aspect of the invention, the above mentioned and other objectives are achieved with a protective device for protecting a head from impact, the device comprising a shell substantially formed in a dome-shape and having a first outer edge; an inner layer substantially formed in the dome-shape disposed within the shell, having an second outer edge and arranged at a gap distance in a direction of the surface normal of the shell, at least one connecting member interconnecting the shell and inner layer by interconnecting the first outer edge and the second outer edge, an intermediary structure comprising a plurality of deformable elements arranged in a single layer, wherein each of the deformable elements, in an un-deformed state, is arranged in simultaneous contact with the shell, the inner layer and at least one other deformable element of the of deformable elements.

At least an advantage of the invention according to the first aspect is to reduce angular acceleration and angular velocity of a head to be protected by reducing the amount of imposed rotational kinematics on the protected object, such as the head, due to the very low shear resistance of the loosely adhered spheres which will slide against each other and/or the shell and inner layer when the shell is subjected to oblique impacts or forces. The deformable elements, e.g. in the form of spheres, ellipsoids or pads, are initially in contact with each other and/or in contact with both the shell and the inner layer of an intermediary structure in a protective helmet, or other type of protective structure. As the spheres are not adhered to each other, or only lightly adhered, they will be able to roll and/or slide when the shell of the protective helmet/structure is subject to an oblique or slanted impact force.

Further applications and advantages of embodiments of the invention will be apparent from the following detailed description.

Figure 1:
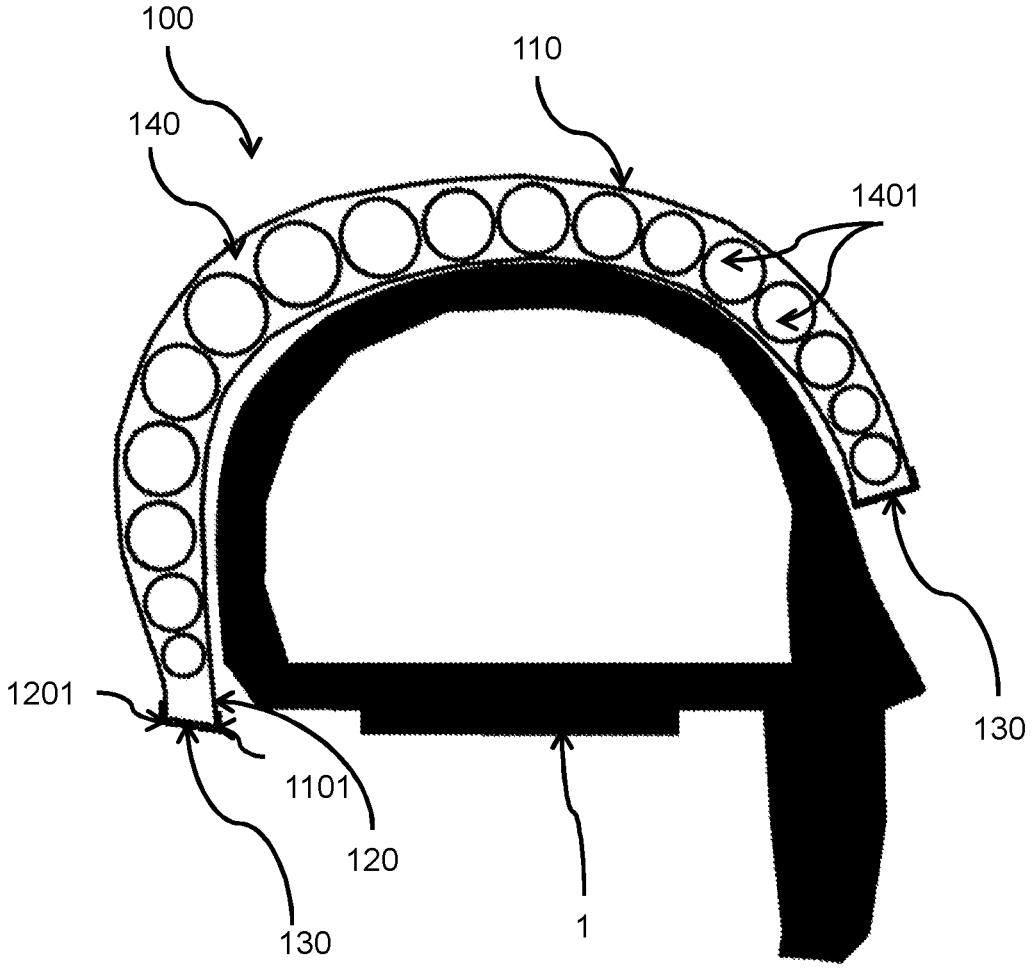
FIG. 1 shows a section view of a protective device 100, e.g. in the form of a helmet, for protecting a head 1 from impact according to one or more embodiments of the present disclosure.

A more complete understanding of embodiments of the invention will be afforded to those skilled in the art, as well as a realization of additional advantages thereof, by a consideration of the following detailed description of one or more embodiments. It should be appreciated that like reference numerals are used to identify like elements illustrated in one or more of the figures.

DETAILED DESCRIPTION

The present disclosure aims at reducing the amount of imposed rotational kinematics on the protected object, such as the head of a person. The disclosure solves this by providing deformable elements having a very low shear resistance, which will allow them to slide and/or roll during an impact.

The deformable elements may be formed or shaped as spheres or other pieces of material such as ellipsoids, pads or other geometrical shapes that have spherical inner and outer contact surfaces facing towards the shell and inner layer. The deformable elements are initially in contact with each other and with both the shell and the inner layer of a compartment or intermediary structure in a protective helmet or other type of protective device. The spheres are not adhered to each other, or only lightly adhered, so that they will be able to roll and/or slide and/or shear when the protective device is subject to an impact force of an oblique or slanted impact, such that the shell is displaced relative to the inner layer.

The present disclosure comprises substantially large deformable elements, such as spheres, that are in contact with each other and/or the shell and/or inner layer, The deformable elements will then, when subjected to a force, either roll, shear or slide relative the shell and/or inner layer and/or and each other, thereby limiting the transfer of tangential forces to the head which in turn will reduce or dampen the angular acceleration and angular velocity of the head. This significantly improves the protection against angular acceleration of the head compared to conventional solutions such as small spheres, spheres not initially close to each other or spheres connected with elastic bands or other elastic or rigid structures. Small spheres will not roll nor deform to the same extent as in the present disclosure since they will roll in different directions to each other due to the geometric constraint of rolling due to frictional contact. Elastic bands will limit and resist any rolling.

Interestingly, in the disclosure described herein, the protection is markedly improved by using spheres that can roll and separate in the intermediate layer to reduce angular acceleration/angular velocity and this design further reduces the angular forces significantly, to approximately 70% compared to a regular helmet design where the outer shell is glued to the liner. These and subsequent comparisons were made using an advanced computer model described in U.S. application Ser. No. 12/454,538.

FIG. 1 shows a section view of a protective device 100, e.g. in the form of a helmet, for protecting a head 1 from impact according to one or more embodiments of the present disclosure. The protective device 100 comprises a shell or outer layer 110 substantially formed in a dome-shape and having a first outer edge 1101. The first outer edge 1101 may be formed by a plane intersecting the dome shape or formed in an arbitrary pattern depending on the desired shape of the helmet. The shell 110 may be relatively thin and strong so as to withstand impact of various types and can advantageously be made of, for example, fiber-reinforced plastic. The protective device 100 further comprises an inner layer 120 substantially formed in the dome-shape and disposed within the shell 110. The inner layer 120 may be intended for contact with the head of the wearer. The inner layer 120 having a second outer edge 1201 and is arranged at a gap distance in a direction of the surface normal of the shell 110. The second outer edge 1201 may be formed by a plane intersecting the dome shape or formed in an arbitrary pattern depending on the desired shape of the helmet. Typically the outline of the second outer edge 1201 substantially follows the outline of the first outer edge 1101. The inner layer 120 may be considerably thicker and is capable of damping or absorbing impacts against the head. It can advantageously be made of, for example, hard plastic, polyurethane foam, polypropylene foam or polystyrene. The protective device 100 further comprises at least one connecting member 130 interconnecting the shell 110 and inner layer 120 by interconnecting the whole of the first outer edge 1101 with the whole of the second outer edge 1201 and/or at least parts of the first outer edge 1101 with parts of the second outer edge 1201. The at least one connecting member 130 further counteract mutual displacement between them by absorbing energy, i.e. limits or restricts the relative movement of the shell 110 relative the inner layer 120. As connecting members 130, use can be made of, for example, deformable strips of plastic or metal which are anchored to the outer shell 110 and the inner layer 120 in a suitable manner. The protective device 100 further comprises an intermediary structure 140 disposed between the shell 110 and the inner layer 120. The intermediary structure 140 comprises a plurality of deformable elements 1401 arranged in a single layer. The intermediary structure 140 provides possible displacement between the shell 110 and the inner layer 120. Each of the deformable elements 1401, when in an un-deformed state or normal state, is arranged in simultaneous contact with the shell 110, the inner layer 120 and at least one other deformable element of the deformable elements 1401. The deformable elements 1401 of the intermediate layer 140 are configured to be capable of damping or absorbing impacts against the head. It can advantageously be made of, for example, hard plastic, polyurethane foam, polypropylene foam or polystyrene.

At least one effect of the simultaneous contact of the deformable elements 1401 is that angular acceleration and angular velocity of a head, to be protected by the protective device 100, is further reduced. By reducing the amount of imposed rotational kinematics on the protected object, such as the head, due to the very low shear resistance of the loosely adhered spheres which will slide against each other and/or the shell and inner layer when the shell is subjected to oblique impacts or forces. The deformable elements, e.g. in the form of spheres, ellipsoids or pads, are initially in contact with each other and/or in contact with both the shell and the inner layer of an intermediary structure in a protective helmet, or other type of protective structure. As the spheres are in simultaneous contact but not adhered/coupled to each other, the shell or the liner, they will be able to roll and/or slide when the shell of the protective helmet/structure is subject to an oblique or slanted impact force. In other words, simultaneously generating a friction force between the deformable elements 1401 whilst simultaneously generating a friction force between the deformable elements 1401 and the shell 110 as well as generating a friction force between the deformable element 1401 and the inner layer 120.

In one embodiment, the shell 110 and the inner layer 120 comprise materials which are relatively harder than the material of the deformable elements.

In one embodiment, the shell 110 and inner layer 120 comprise a selection of any of fiber-resin lay-up type materials, polycarbonate plastics or polyurethane.

In one embodiment, the deformable elements comprise expanded polystyrene or expanded polypropylene.

In one embodiment, the deformable elements 1401 comprises a first rounded surface facing the shell 110, seen along the radial direction, and a second rounded surface facing the second surface.

In one embodiment, the deformable elements 1401 are configured to absorb impact energy from a normal component NC of an impact force, at a point of impact to the shell 110, by gliding in a direction from the point of impact towards the first outer edge 1101.

In one embodiment, the deformable elements 1401 are configured to absorb impact energy from a tangential component, TC, of an impact force, at a point of impact to the shell 110, by rolling along a curvature of the shell 110.

In one embodiment, the deformable elements 1401 are made from materials relatively harder than the material of the at least one connecting member 130.

The connecting member/s 130 are arranged to counteract mutual displacement between the shell 110 and inner layer and/or provide an initial pre-tension or force to the deformable elements 1401, when in an un-deformed state. In other words, the connecting member/s 130 ensures simultaneous contact of deformable elements 1401, with the shell 110, the inner layer 120 and at least one other deformable element of the deformable elements 1401.

The magnitude of the friction force, e.g. between the deformable elements, may in some embodiments be controlled by the choice of material of the connecting member/s 130. Examples of material includes textile or flexible plastic. E.g. by selecting a material with higher resilience, a higher initial force between the deformable elements is generated. In one embodiment, the at least one connecting member 130 comprises textile or flexible plastic.

In one embodiment, the deformable elements 1401 are coated with a low friction coating.

In one example, the embodiments 1401 of the intermediate layer 140 are coated with a low friction coating. A number of different materials and embodiments can be used as the low friction coating, for example oil, Teflon, microspheres, air, rubber, polyethylene etc. This layer advantageously has a thickness of roughly 0.1-5 mm, but other thicknesses can also be used, depending on the material selected and the performance desired.

Figure 2:
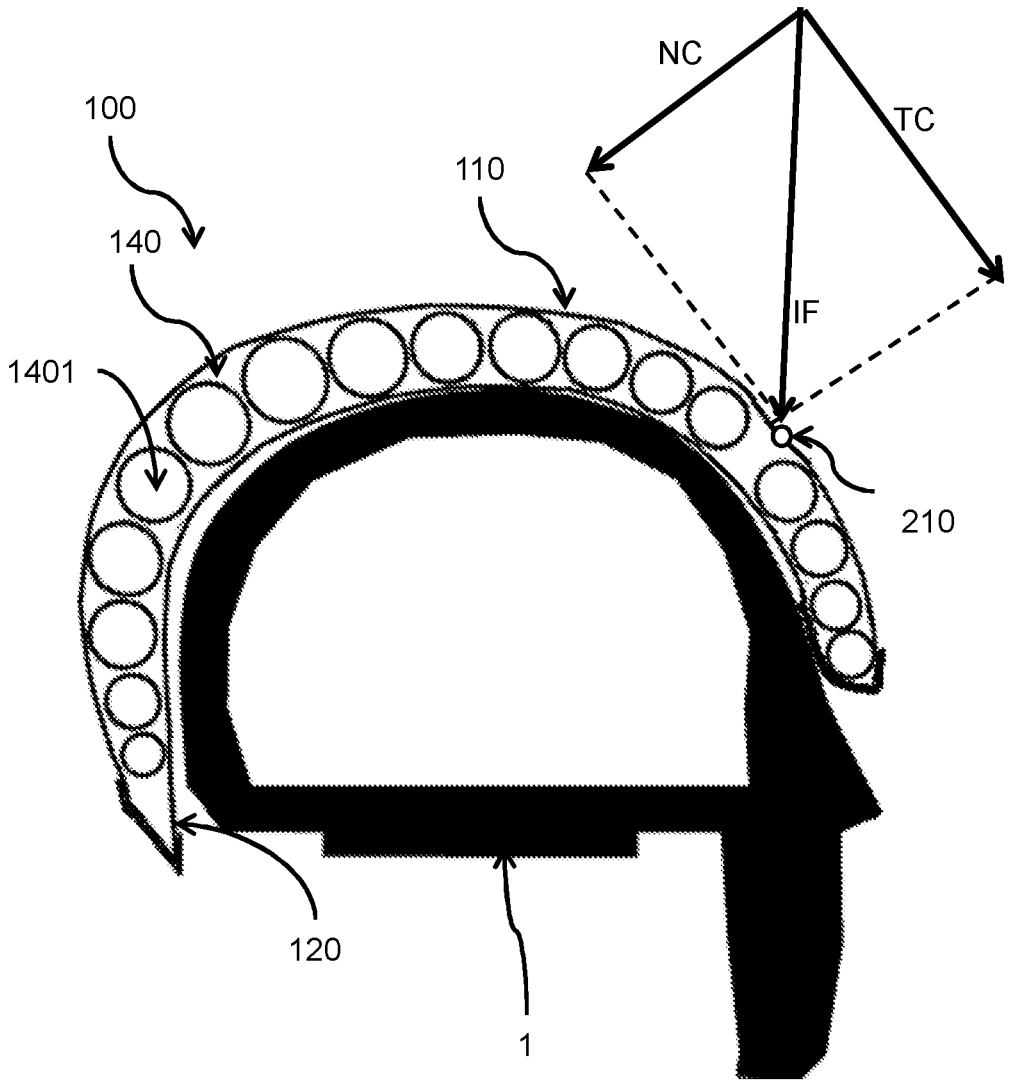
FIG. 2 shows a section view of a protective device 100 receiving an oblique or slanted impact force IF to the surface of the shell 110 according to one or more embodiments of the present disclosure.

FIG. 2 shows a section view of a protective device 100 receiving an oblique or slanted impact force IF to the surface of the shell 110 according to one or more embodiments of the present disclosure. The deformable elements 1401 of the intermediary structure 140 are shown as spheres in FIG. 2. When the helmet 100 is subjected to an oblique or slanted impact force IF, the impact force IF will give rise to both a tangential force component TC and a normal or radial force component NC relative to a point of impact 210 at the shell surface of the protective helmet 100. In this particular context, both the helmet-rotating tangential force TC and the helmet translating normal or radial force component NC and its effect are of interest.

Figure 3:
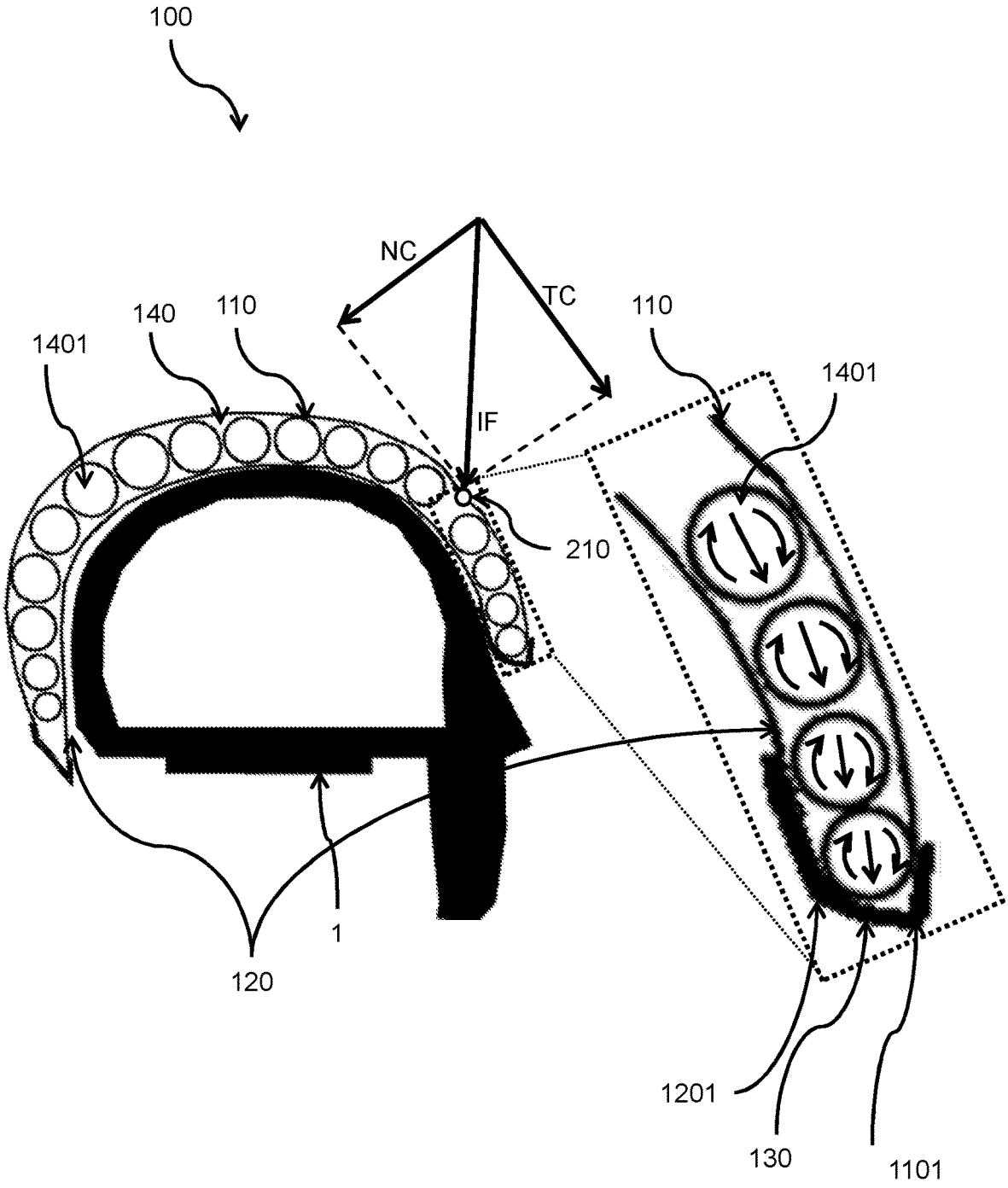
FIG. 3 illustrates the principle of how the protective device 100 protects the head from linear and angular acceleration when receiving an oblique impact force according to one or more embodiments of the present disclosure.

FIG. 3 illustrates the principle of how the protective device 100 protects the head from linear and angular acceleration according to one or more embodiments of the present disclosure. When the protective device 100 receives the impact force IF at a point of impact 210 at the shell 110 surface, the deformable elements 1401 of the intermediary structure 140 are initially in contact with the shell 110, the inner layer and at least one other deformable element of the of deformable elements 1401. The deformable elements 1401 are then configured to absorb impact energy from a normal component NC of the impact force IF, at the point of impact 210 to the shell 110, by sliding in a direction from the point of impact towards the first/second outer edges 1101/1201 and/or the at least one connecting member 130. The deformable elements 1401 are further configured to absorb impact energy from a tangential component TC of the impact force IF, at a point of impact 210 to the shell (110), by rolling or shearing along a curvature of the shell 110 and/or inner layer 120. This will force the deformable elements 1401 to slip in a controlled manner over the surface of the shell 110 and/or inner layer 120, thus limiting the transfer of tangential forces to the head force effectively dampening the rotational movement of the shell 110 relative to the inner layer 120 and therefore reducing angular acceleration and/or angular velocity of the head.

Figure 4:
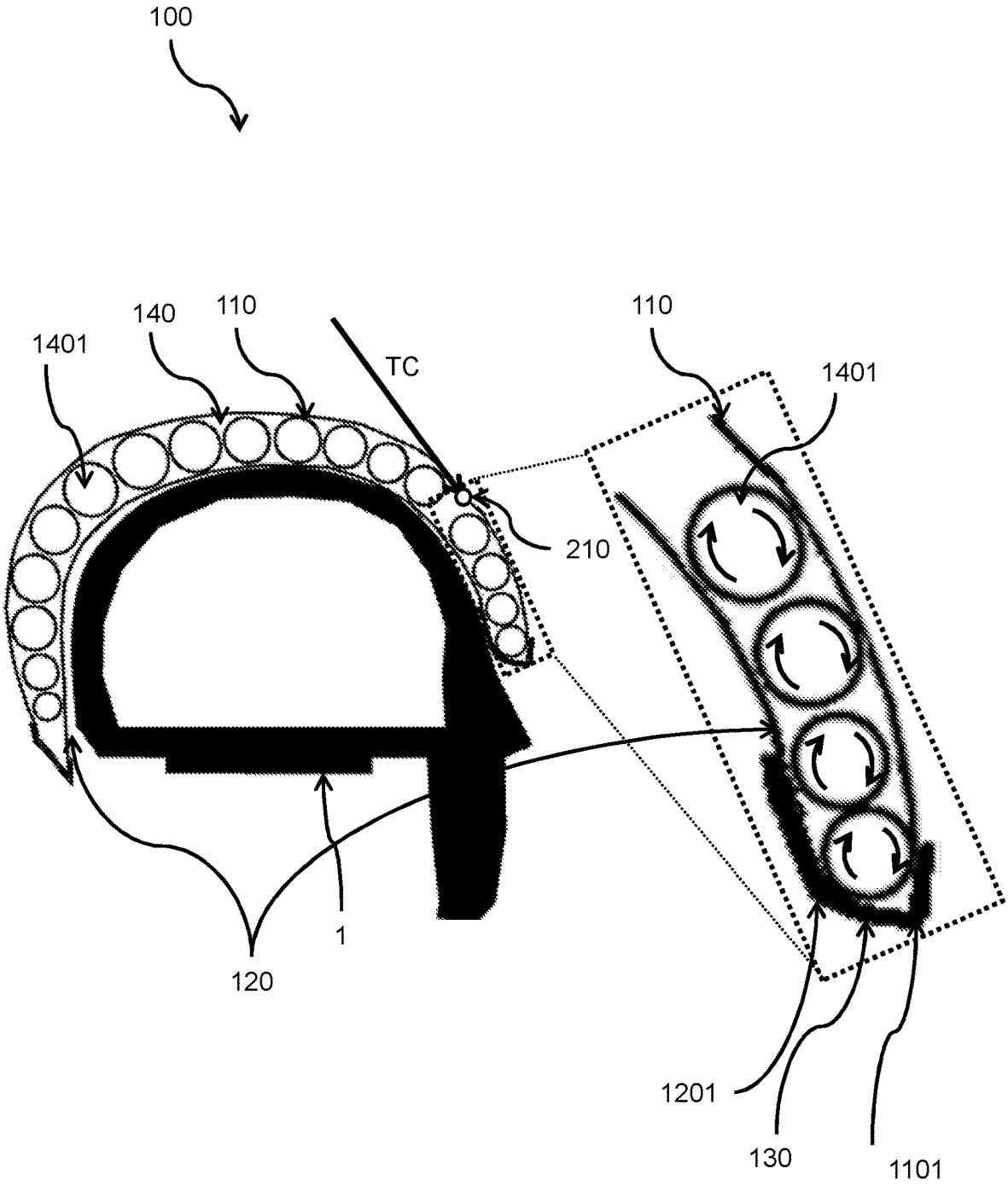
FIG. 4 illustrates the principle of how the protective device 100 protects the head from angular acceleration when receiving the tangential component of an oblique impact force according to one or more embodiments of the present disclosure.

FIG. 4 illustrates the principle of how the protective device 100 protects the head from angular acceleration/angular velocity according to one or more embodiments of the present disclosure. FIG. 4 illustrates the functioning principle of a protective device 100 when subjected only to an impact force IF having only a tangential force component TC. The deformable elements 1401 are configured to absorb impact energy from a tangential component TC of an impact force IF, at a point of impact 210 to the shell 110, mainly by rolling, sliding or shearing along a curvature of the shell 110 and/or the inner layer 120.

Figure 5A:
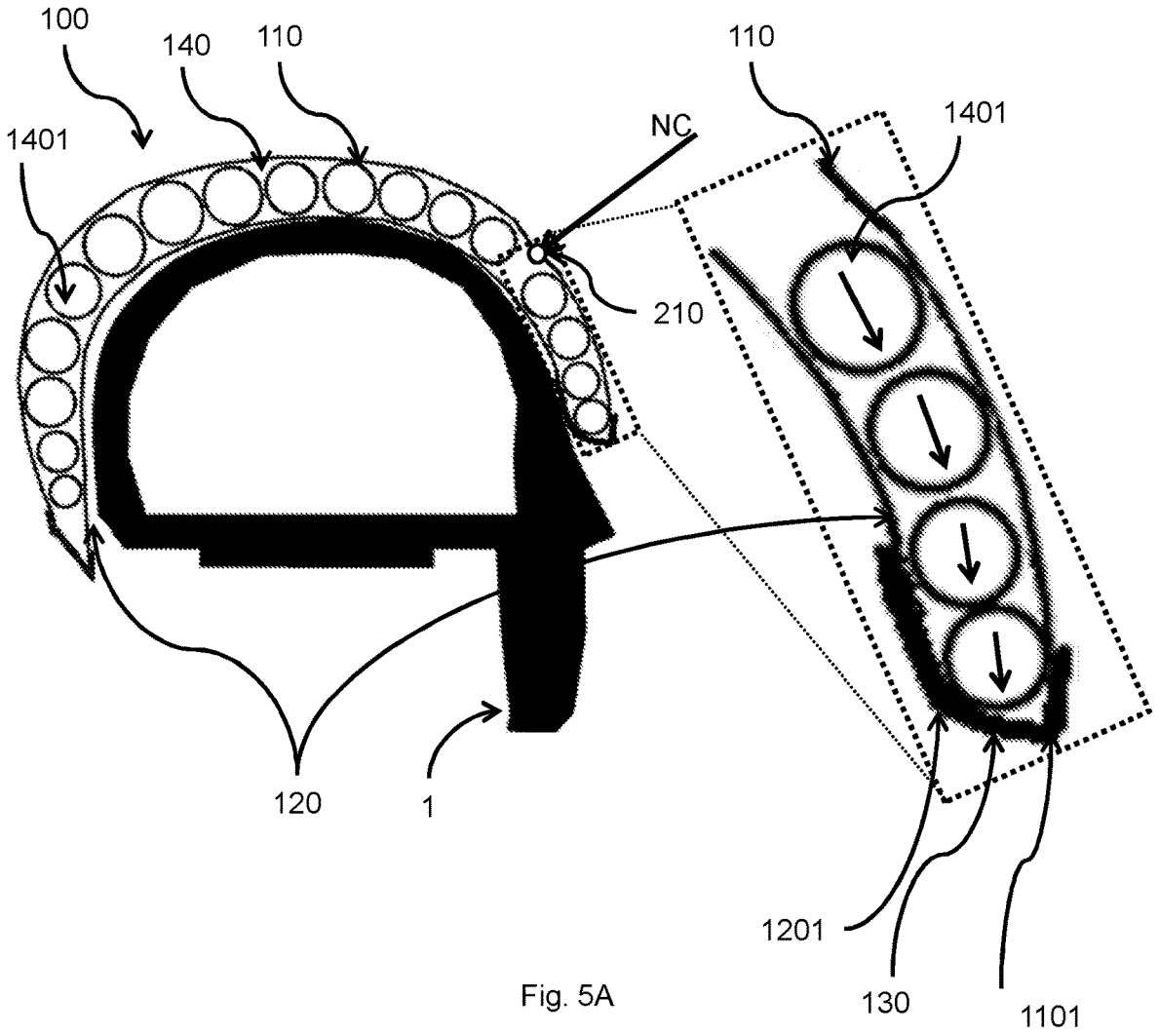
FIG. 5A illustrates the principle of how the protective device 100 protects the head from angular and linear acceleration when receiving the normal component of an oblique impact force according to one or more embodiments of the present disclosure.

FIG. 5A illustrates the principle of how the protective device 100 protects the head from linear acceleration according to one or more embodiments of the present disclosure. FIG. 5A illustrates the functioning principle of a protective device 100 when subjected only to an impact force IF having only a normal force component NC. The deformable elements 1401 are then configured to absorb impact energy from a normal component NC of the impact force IF, at the point of impact 210 to the shell 110, by sliding in a direction from the point of impact towards the first/second outer edges 1101/1201 and/or the at least one connecting member 130.

Figure 5B:
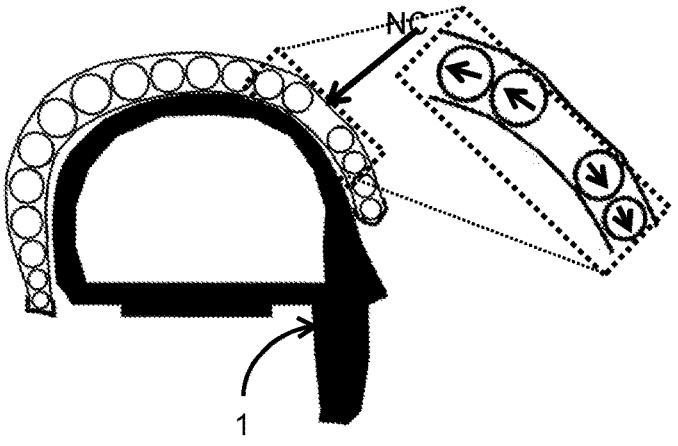
FIG. 5B illustrates how the deformable elements slide in a direction from the point of impact towards the first/second outer edges and/or the at least one connecting member.

FIG. 5B illustrates how the deformable elements 1401 slide in a direction from the point of impact towards the first/second outer edges 1101/1201 and/or the at least one connecting member 130 when subjected only to an impact force IF having only a normal force component NC.

Figure 6:
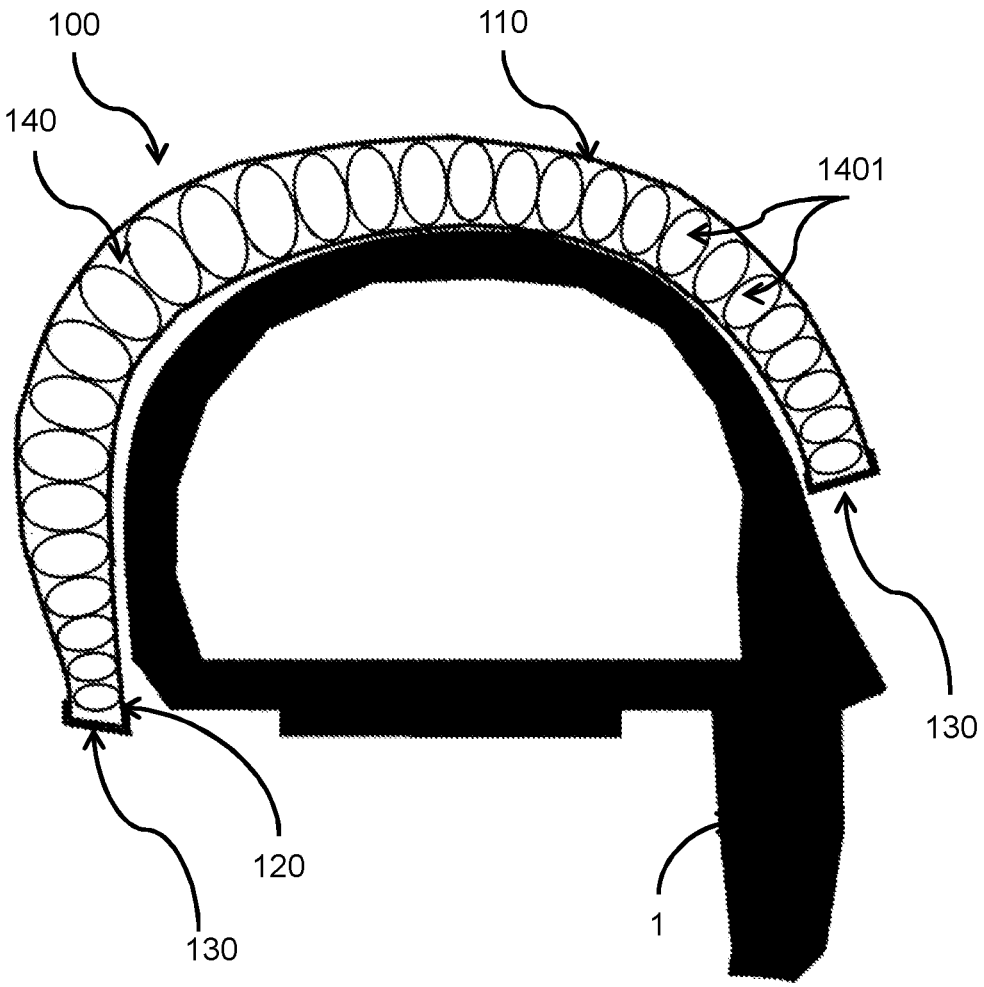
FIG. 6 shows an embodiment where the deformable elements 1401 of the intermediary structure 140 comprises ellipsoids having the longest axis arranged in the radial direction of the shell 110 surface.

FIG. 6 shows an embodiment where the deformable elements 1401 of the intermediary structure 140 comprises ellipsoids having the longest axis, i.e. of the ellipsoids axes of symmetry, arranged in the radial direction of the shell 110 surface. The longest axis may be arranged substantially in a direction parallel to a surface normal of the shell, when in an un-deformed state.

Figure 7:
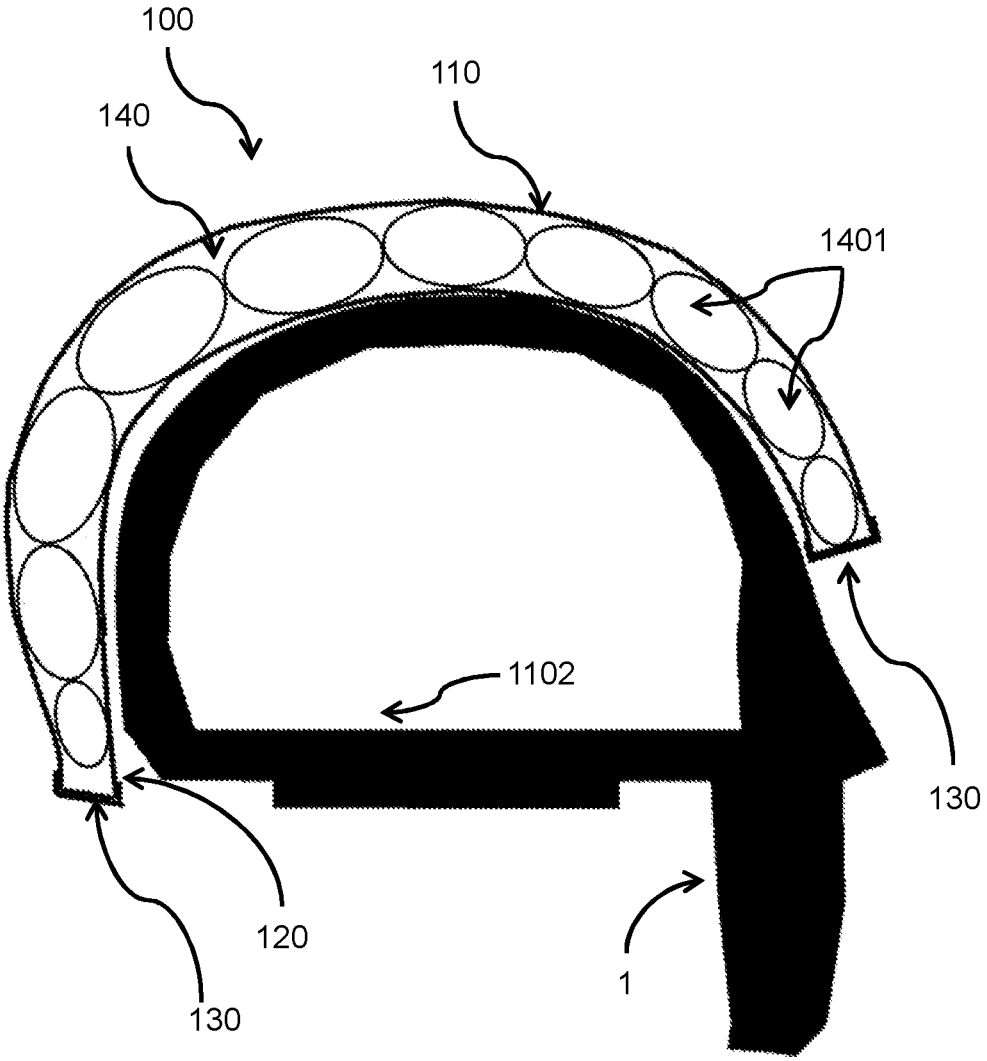
FIG. 7 shows an embodiment where the deformable elements 1401 of the intermediary structure 140 comprises ellipsoids having the shortest axis arranged in the radial direction of the shell 110 surface.

FIG. 7 shows an embodiment where the deformable elements 1401 of the intermediary structure 140 comprises ellipsoids having the shortest axis, i.e. of the ellipsoids axes of symmetry, arranged in the radial direction of the shell 110 surface. The shortest axis may be arranged substantially in a direction parallel to a surface normal of the shell, when in an un-deformed state.

Figure 8:
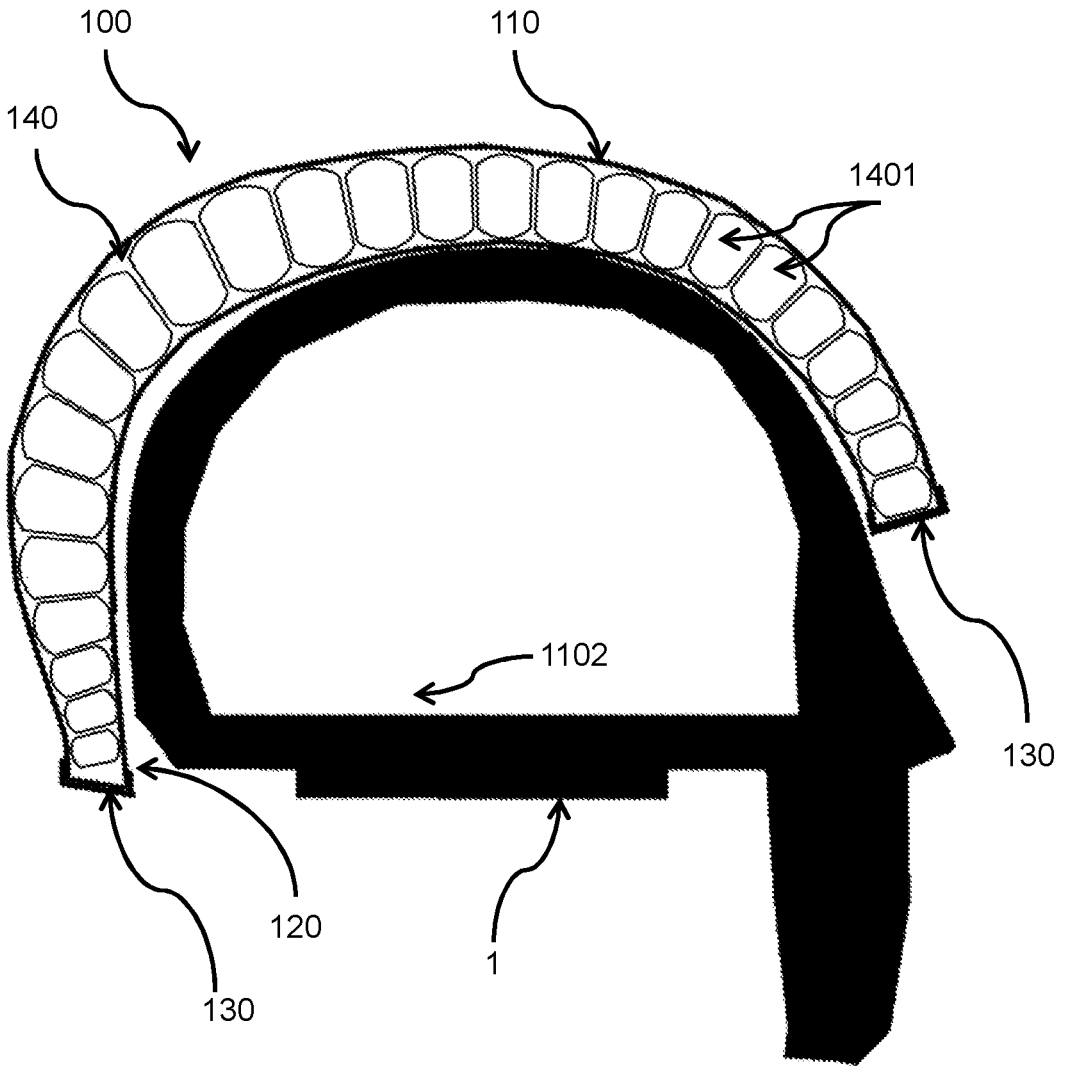
FIG. 8 shows an embodiment where the deformable elements 1401 of the intermediary structure 140 comprises deformable elements 1401 that have spherical inner and outer contact surfaces facing towards the shell 110 and inner layer 120 and straight or plane surfaces in the circumferential direction towards each other.

FIG. 8 shows an embodiment where the deformable elements 1401 of the intermediary structure 140 comprises deformable elements 1401 that have spherical or rounded inner and outer contact surfaces facing towards the shell 110 and inner layer 120 and straight or plane surfaces in the circumferential direction towards each other. In other words, the formable elements 1401 of the intermediary structure 140 are elongated and have a longitudinal axis. The longitudinal axis may be arranged substantially in a direction of a surface normal of the shell, when in an un-deformed state. The straight or plane surfaces of the deformable elements 1401 may in one embodiment be substantially arranged parallel to a surface normal of the shell.

In one embodiment, each of the deformable elements 1401 is formed as a selection of any of a rectangular block, a sphere, an ellipsoid or a cylinder having rounded ends.

Figure 9:
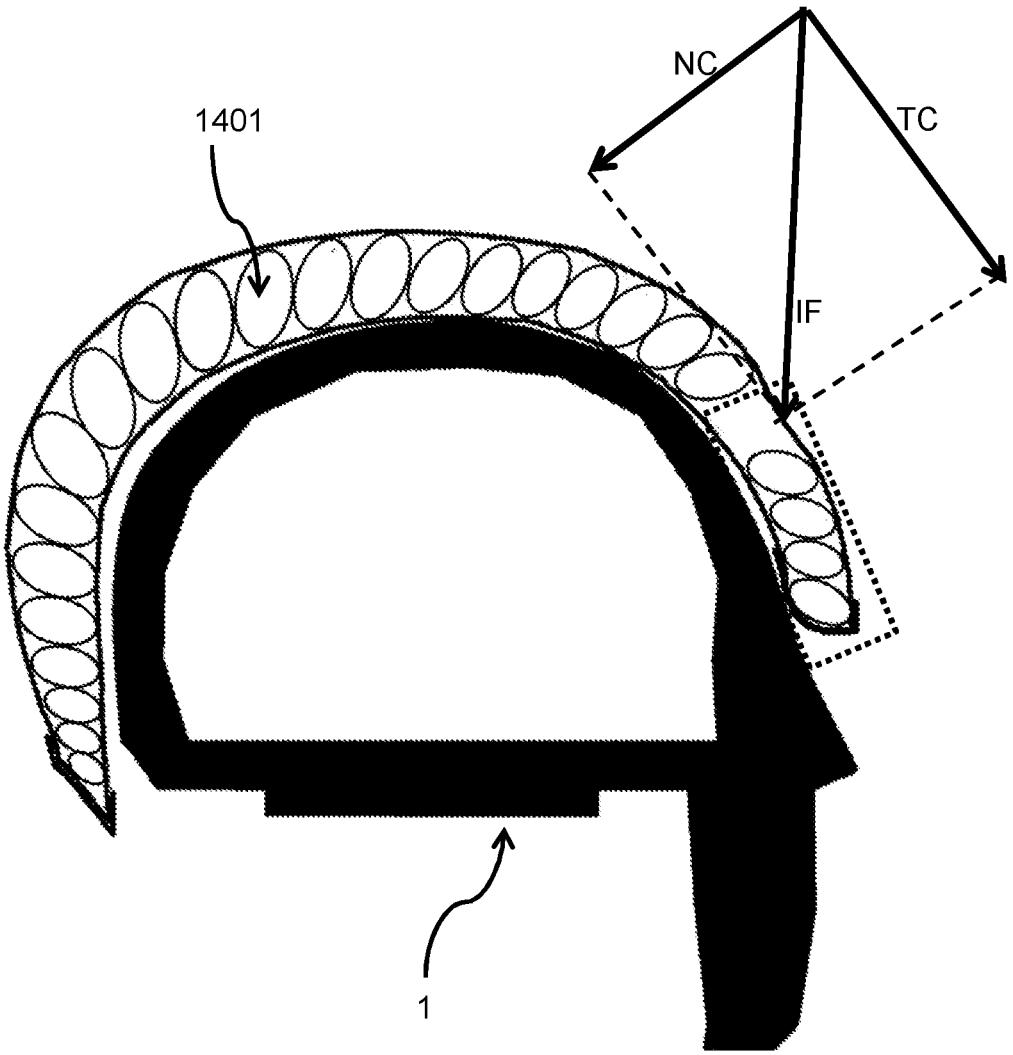
FIG. 9 shows an example where the deformable elements 1401 comprise ellipsoids having the longest axis arranged in the radial direction of the shell 110 surface and are being subjected to an impact force.

FIG. 9 shows an example where the deformable elements 1401 comprise ellipsoids having the longest axis arranged in the radial direction of the shell 110 surface and are being subjected to an impact force.

Figure 10:
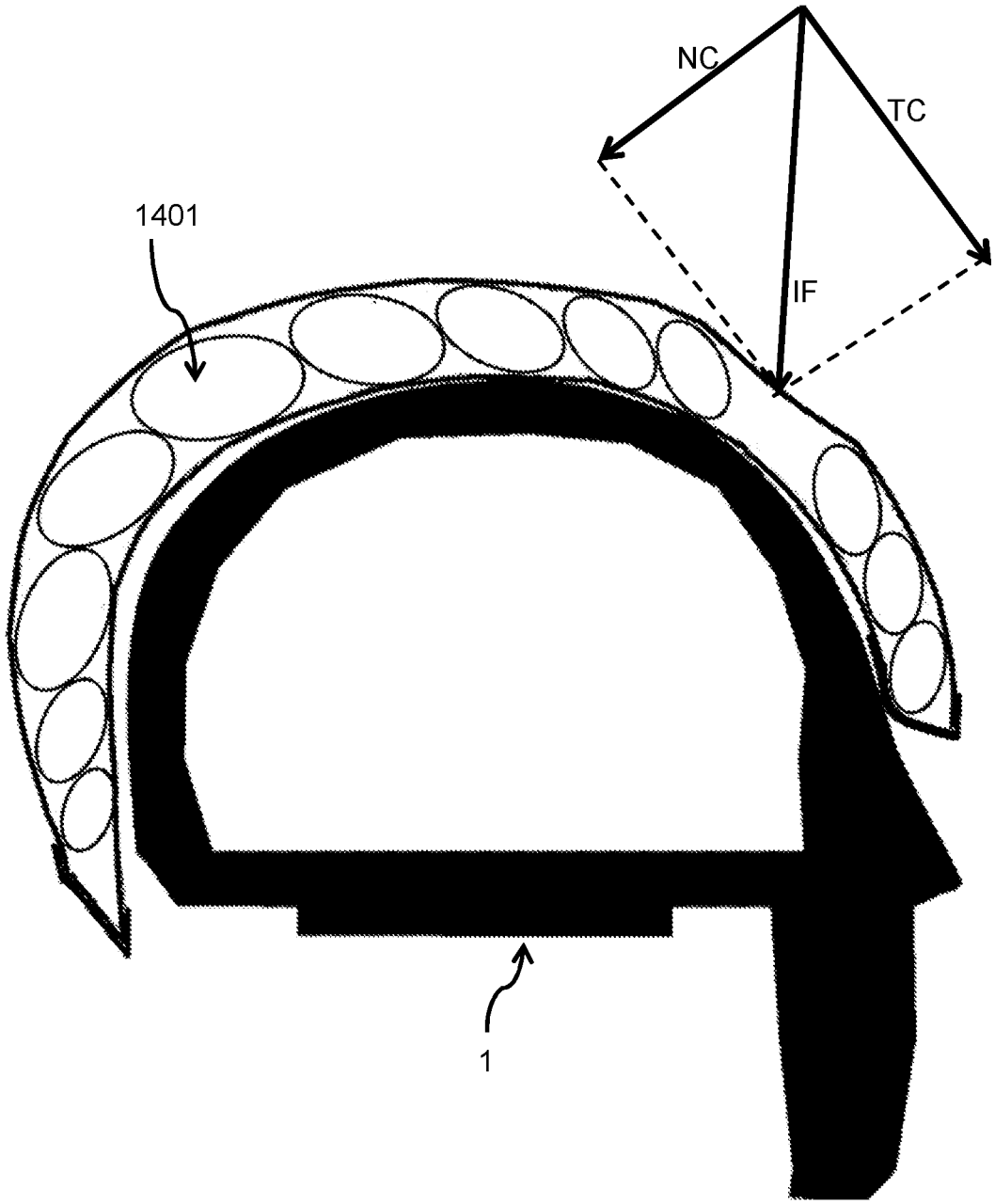
FIG. 10 shows an example where the deformable elements 1401 comprise ellipsoids having the shortest axis arranged in the radial direction of the shell 110 surface and are being subjected to an impact force IF.

FIG. 10 shows an example where the deformable elements 1401 comprise ellipsoids having the shortest axis arranged in the radial direction of the shell 110 surface and are being subjected to an impact force IF.

Figure 11:
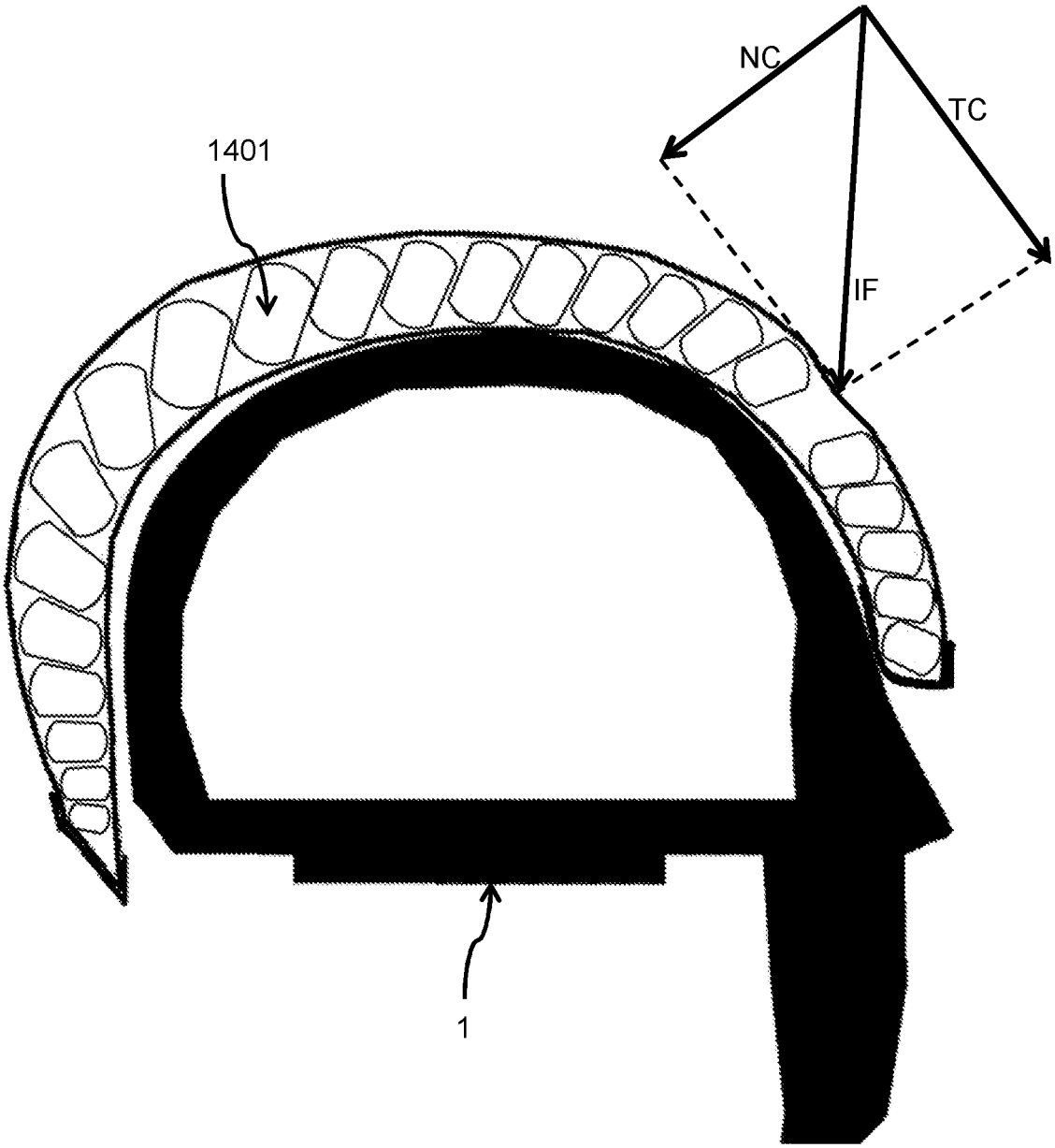
FIG. 11 shows an example where the deformable elements 1401 comprise deformable elements 1401 that have spherical inner and outer contact surfaces surface and are being subjected to an impact force IF.

FIG. 11 shows an example where the deformable elements 1401 comprise deformable elements 1401 that have spherical inner and outer contact surfaces surface and are being subjected to an impact force IF.

Finally, it should be understood that the disclosure is not limited to the embodiments described above, but also relates to and incorporates all embodiments within the scope of the appended independent claims.

The invention claimed is:

1. A protective device for protecting a head from impact, the device comprising: a shell substantially formed in a dome-shape and having a first outer edge;

an inner layer substantially formed in the dome-shape disposed within the shell, having a second outer edge and arranged at a gap distance in a direction of the surface normal of the shell, at least one connecting member interconnecting the shell and inner layer by interconnecting the first outer edge and the second outer edge, an intermediary structure comprising a plurality of deformable elements arranged in a single layer, wherein each the plurality of deformable elements comprises a first rounded surface facing the shell and a second rounded surface facing the inner layer, wherein each of the plurality of deformable elements, in an un-deformed state, is arranged in simultaneous contact with the shell, the inner layer and at least one other deformable element of the plurality of deformable elements, wherein the plurality of deformable elements is configured to absorb impact energy from a normal component (NC) of an impact force, at a point of impact to the shell, by sliding in a direction from the point of impact towards the first/second outer edges and/or the at least one connecting member, and wherein the plurality of deformable elements is configured to absorb impact energy from a tangential component (TC) of an impact force, at a point of impact to the shell, by rolling along a curvature of the shell.

2. The device according to claim 1, wherein the shell and inner layer comprise materials relatively harder than a material of the plurality of deformable elements.

3. The device according to claim 2, wherein the shell and inner layer comprise a selection of any of fiber-resin lay-up type materials, polycarbonate plastics or polyurethane.

4. The device according to claim 2, wherein the plurality of deformable elements comprises expanded polystyrene or expanded polypropylene.

5. The device according to claim 1, wherein each of the plurality of deformable elements has a shape selected from the group consisting of a sphere, an ellipsoid or a cylinder having rounded ends.

6. The device according to claim 1, wherein the plurality of deformable elements is made from materials relatively harder than a material of the at least one connecting member.

7. The device according to claim 6, wherein the at least one connecting member comprises textile or flexible plastic.

8. The device according to claim 1, wherein the plurality of deformable elements is coated with a low friction coating.

9. The device according to claim 1, wherein the first outer edge of the shell and the second outer edge of the inner layer are spaced from one another and the at least one connecting member extends between the first outer edge and the second outer edge.

10. The device according to claim 1, wherein the shell and the inner layer are movable relative to each other, and this relative movement is limited by the at least one connecting member.

* * * * *